United States Patent [19]

Cook

[11] 4,068,639

[45] Jan. 17, 1978

[54] AUTOMOBILE ENGINE ECONOMIZER

[76] Inventor: Earl Charles Cook, 15 Hawthorne Way, Apt. 106, San Jose, Calif. 95110

[21] Appl. No.: 696,078

[22] Filed: June 14, 1976

Related U.S. Application Data

[63] Continuation-in-part of Ser. No. 559,322, March 17, 1975, abandoned, and Ser. No. 441,114, Feb. 11, 1974, abandoned.

[51] Int. Cl.[2] ..... F02M 13/06; F02B 75/12

[52] U.S. Cl. ..... 123/127; 123/1 A; 123/121; 123/180 AC; 123/198 A

[58] Field of Search ..... 123/127, 121, 119 B, 123/179 G, 179 L, 180 AC, 198 A, 1 A

[56] References Cited

U.S. PATENT DOCUMENTS

| | | | |
|---|---|---|---|
| 1,926,449 | 9/1933 | Lindsey | 123/127 |
| 1,970,425 | 8/1934 | Grabbe | 123/127 |
| 2,050,978 | 8/1936 | Thatcher | 123/127 |
| 2,675,793 | 4/1954 | Ziege | 123/121 |
| 2,701,133 | 2/1955 | Mendez | 123/121 |
| 2,767,691 | 10/1956 | Mengelkamp | 123/121 |
| 2,855,759 | 10/1958 | Chaiser | 123/121 |
| 2,996,892 | 8/1961 | Clark | 123/121 |
| 3,650,255 | 3/1972 | McJones | 123/121 |
| 3,659,574 | 5/1972 | Reschke | 123/121 |
| 3,718,000 | 2/1973 | Walker | 123/121 |

*Primary Examiner*—Charles J. Myhre
*Assistant Examiner*—Daniel J. O'Connor

[57] ABSTRACT

This device consists primarily of a liquid propane tank with vapor outlet, a vapor storage tank with regulator means, and valve and solenoid means for properly blending propane vapor as the secondary fuel with gasoline as the primary fuel, so as to substantially increase the volumetric efficiency of an internal combustion engine, while simultaneously reducing the unburned hydrocarbons emitted by said engine.

5 Claims, 2 Drawing Figures

AUTOMOBILE ENGINE ECONOMIZER

This case is a continuation-in-part of Ser. Nos. 441,114, filed Feb. 11, 1974, and now abandoned, and 559,322, filed Mar. 17, 1975, and now also abandoned, for an Automobile Engine Economizer, insofar as the material common to all cases is concerned.

This invention relates to automotive engines, and more particularly to an automotive engine economizer.

It is therefore the principal object of this invention to provide an automotive engine economizer which will blend propane vapor with gasoline vapor while increasing the effectiveness of both fuels as a whole rather than individually.

Another object of this invention is to provide an economizer device or system, which when operating, will serve to reduce the unburned hydrocarbons emitted by said engine.

Still another object of this invention is to provide an economizer system for automotive vehicles which will include a liquid propane tank carried within the trunk of the vehicle, said container being connected by line means to a vapor storage tank having a pressure gauge, and carried within the engine compartment.

Yet another object of this invention is to provide an economizer device of the type described which will include a safety shut-off valve, a pressure regulator, a hand control, an expansion tank, and main control valve means which operates in conjunction with idling circuit valves, an idling pressure regulator and solenoid valve, a vacuum switch, a damper-actuated microswitch ground for air-cooled engines, or a liquid coolant-operated sensor switch for liquid-cooled engines, modified acceleration pump levers, and a propane vapor solenoid, means to effectively combine propane vapor as the secondary fuel with the gasoline fuel-and-air mixture being drawn into the cylinders of the internal combustion engine of the vehicle so equipped.

Still another object of this invention is to provide a distributor-vacuum advance-control in the form of a combination vacuum tank and three-way solenoid valve attached to the distributor advance port of the controlling liquid-fuel carburetor in such a way as to stabilize said vacuum, thus allowing for whatever uses of said vacuum may have done to reduce its effectiveness.

Another object of this invention is to provide a source of heat for the heat exchanger which may be used to condition the propane vapor as it is directed into the induction system of the automotive engine so equipped; said heat may be supplied by discharged air from an air-cooling system, or by suitable liquid-carrying hose line means in a liquid-cooled system.

Other objects of this invention are to provide an automotive engine economizer which is simple in design, inexpensive to build, rugged in construction, easy to adjust and to use, and efficient in operation.

These and other objects will be readily evident upon a study of the following specification and the accompanying drawings, wherein:

The drawings are the sole view of the instant invention.

Figure 1:
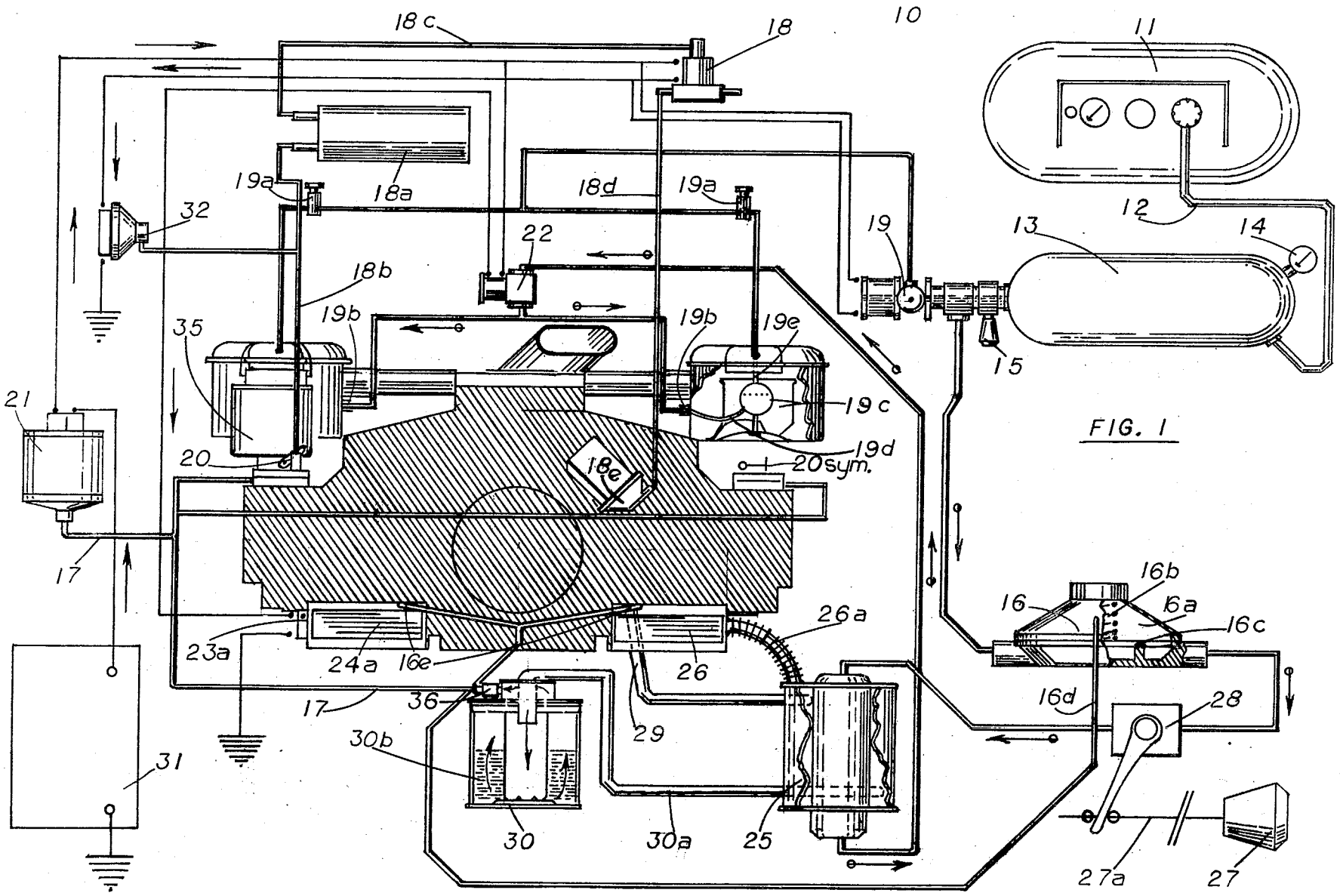

FIG. 1, page 1— Schematic of system 10 as applied to an air-cooled internal combustion engine, showing said engine in a shaded elevation with the numbered components of said system in their relative locations. Included are side elevations, partially sectioned, of propane vapor regulator 16, heat exchanger 25, one air filter with perforated plastic ball and restricting tube 19*c*, and a side elevation in section of the crankcase emission filter 30.

Figure 2:
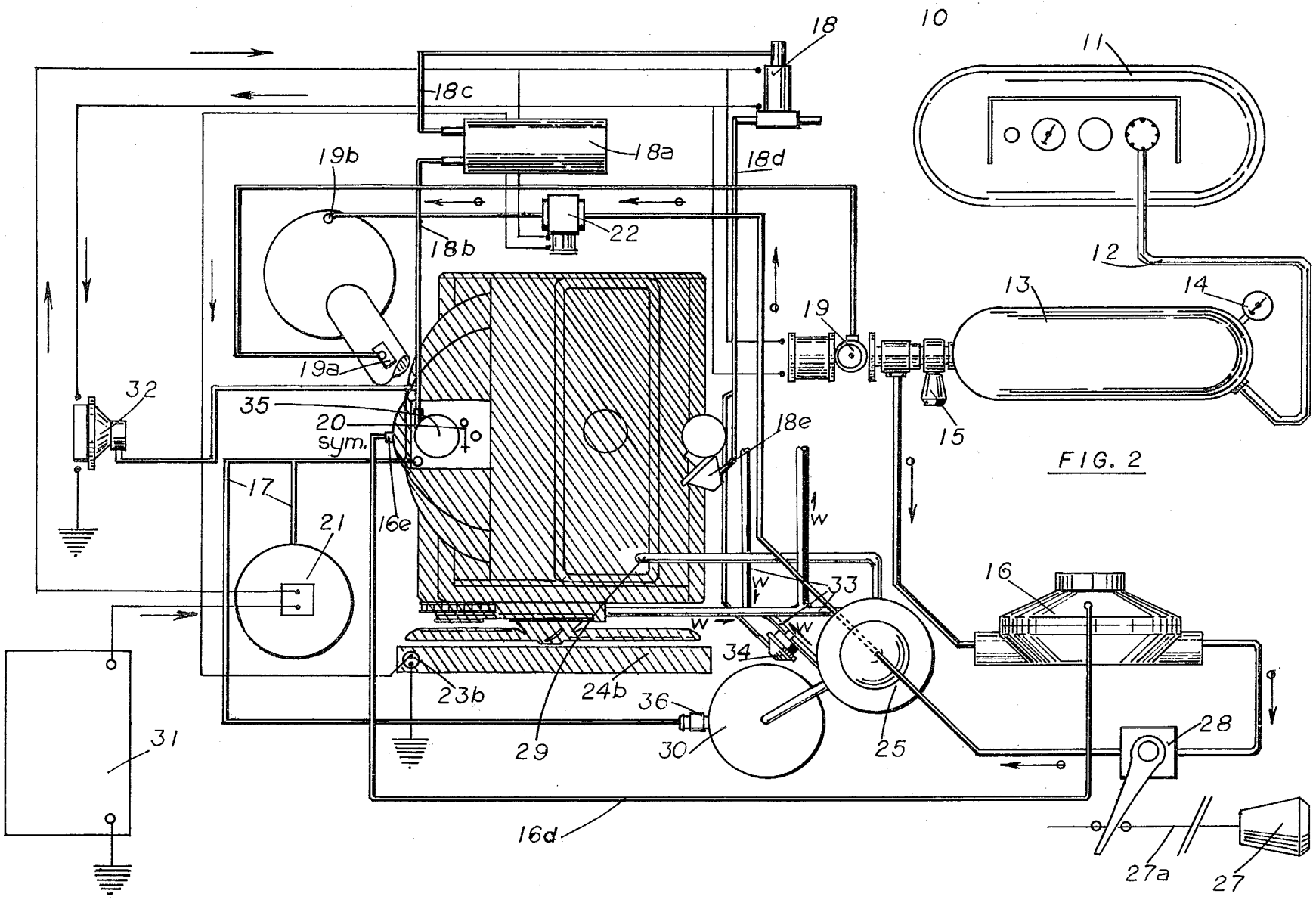

FIG. 2, page 2— Schematic of system 10 applied to a liquid-cooled internal combustion engine, showing said engine in a shaded top view, with the numbered components in their respective positions in the system. Air tube means from air filter to carburetor 35 is cut for clarity of manifold connections.

It shall be noted that economizer 10 does not depend upon a warm engine, but is a part of the starting process, and runs automatically until the shut-off valve 28 is closed, the ignition turned off, and the engine stops. It will also be observed that in the operation of economizer 10, neither fuel along will sustain the operation of the engine at idling.

A liquid propane tank with vapor outlet 11 is located in the trunk of the vehicle and is connected by hose line means 12 to a vapor storage tank 13 within the engine compartment. The vapor storage tank 13 is provided with a pressure gauge 14 for the visual indication of the pressure in said tank. The economizer 10 also includes a safety shut-off valve 15 which is carried on the vapor storage tank 13. The pressure regulator 16 of economizer 10 is of the type used for standard household propane equipment, slightly modified to perform in a poly-phase manner.

Back pressure from the exhaust manifold 16*e* of said engine may be utilized as a controlling medium and may be communicated by line means 16*d* to the control chamber 16*a* of pressure regulator 16, and acting with the initial spring pressure that was established with engine idling, becomes the governing factor at higher speeds.

The idling solenoid 19 and manually adjustable valves 19*a* serve to meter the idling propane vapor. Solenoid 19 is controlled by distributor advance vacuum switch 32. Zero vacuum opens solenoid 19, supplying propane vapor to the idling engine.

The system 10 illustrated is for both air-cooled and liquid-cooled engines, foreign and domestic. Some restrictions are made in the main jets of the carburetors of such engines, as well as in the idling adjustments, acceleration pump levers 20, and ignition timing. A reduction of 27.5% is made in the main jets, idling gasoline is reduced by nearly one half, and the acceleration pump lever 20 (symbolic) travel is reduced by one half.

The main electrical control is a vacuum switch 21 which operates on manifold vacuum through the vacuum tube 17. A solenoid propane vapor valve 22 controlled by manifold vacuum switch 21 serves to admit propane vapor into the induction system of said engine at point 19*b* when the restrictions in the main jets and/or the acceleration pumps are evident.

The vacuum switch 21 may be by-passed by a microswitch ground 23*a* which may be mounted on the left air-cooling discharge damper 24*a* of an air-cooled engine, and when said engine is cold may act as an automatic choke. A liquid coolant sensor switch 23*b*, mounted in the radiator 24*b* of a liquid-cooled engine may perform the identical function.

The main control valve 28 is driver-operated, manually, through hand knob 27 and cable 27*a*, ½ second before engine is cranked for starting.

OPERATION

Operation of said device or system 10 may begin ½ second before turning engine ignition key to crank the starter of the engine so equipped. Operator may pull hand knob 27 located at some convenient position, which may be connected by flexible cable 27*a* to main control valve 28. Said action may permit propane vapor to enter induction system at point 19*b* where cranking and ignition immediately utilize said vapor before gasoline vapor can be formed and ignited.

A micro-switch ground means 23*a* may be mounted on the left air-cooling discharge damper 24*a* of an air-cooled engine so equipped, and may be in the OFF position due to the engine being cold, with damper 24*a* in a closed position. A liquid coolant sensor switch 23*b* located in the radiator 24*b* of a liquid-cooled engine performs in much the same manner. Electrical current (plain arrows) may be ungrounded due to the OFF position of either of said switches, and may permit the free flow of propane vapor from the regulator 16 through heat exchanger 25, solenoid valve 22, and through suitable tubing to points 19*b* on the air filters.

Provision is made in this invention to locate the means for the admission of propane vapor into the induction system of the engine so equipped at the air filter rather than at the carburetor. The offset-updraft air filters (experimental vehicles) are modified to contain a reversed venturi 19*c* for the purpose of injecting said propane vapors into the airstream before said airstream reaches the carburetors. A plastic ball 19*c* may be mounted on the filter-securing bolt 19*e* and may be connected to union 19*b* by plastic tubing 19*d*. Plastic ball 19*c* may be perforated to permit passage of said propane vapors into the airstream. Air passage through the air filters may be restricted to the area of the plastic ball 19*c* by the metal tube (also 19*c*).

Crankcase emissions may be taken from the engine rocker arm cover or breather pipe 29, depending upon the age of the vehicle, to inlet of heat exchanger 25 by suitable hose line means. After passing one time only through said heat exchanger 25 gases are directed through flexible hose 30*a* to filter 30 and through the renewable poly-urethane foam filter element 30*b*, and finally to the PCV valve 36. Additional heat may be supplied to heat exchanger 25 by flexible hose means 26*a* from the right air-cooling discharge damper 26 of the air-cooled engine so equipped, until said discharge damper is fully open and discharging freely. Heat exchanger 25 on a liquid-cooled engine may include a hot-water coil 33 and suitable hose means to and from the engine cooling system via the passenger compartment heater circuit. Distributor advance vacuum may control hot-water by-pass 34.

As engine warms, air-cooling discharge damper 24*a* may open, causing micro-switch 23*a* to close and ground electrical circuit (plain arrows) as it moves to ON position and may bring into automatic operation manifold vacuum switch 21 and propane vapor solenoid valve 22. Said vacuum switch may operate from manifold vacuum tubing 17 to control electrical energy diverted from engine supply at battery 31.

As liquid-cooled engine so equipped warms, liquid coolant sensor switch 23*b*, located in radiator 24*b* of said engine, closes and grounds electrical current from battery 31 through manifold vacuum switch 21, and propane solenoid valve 22, to begin automatic operation of system 10 as herein described.

Energized manifold vacuum switch 21 may supply to propane vapor solenoid valve 22 the current necessary to close said valve and thus cut flow of propane vapor through heat exchanger 25, and through suitable tubing to point 19*b*.

At idling a distributor-advance vacuum-operated micro-switch 32 may permit flow of current to micro pressure-regulating and solenoid valve 19. Distributor advance vacuum is at zero, and said pressure-regulating and solenoid valve 19 is supplying about one half the propane vapor fuel for this stage. As distributor advance vacuum increases and manifold vacuum decreases (1) distributor-advance vacuum switch 32 opens to cut flow of electrical current to pressure-regulating and solenoid valve 19, closing said solenoid, and thus shutting down the idling stage; (2) as manifold vacuum continues to fall, manifold vacuum switch 21 opens and cuts flow of current to propane vapor solenoid valve 22, which opens said solenoid valve and permits full flow of propane vapor to the engine so equipped which is in the process of full acceleration.

Incidental with the operation of vacuum switch 32 and idling solenoid 19 are the distributor-advance vacuum tank 18*a* and the three-way solenoid valve 18. Vacuum tank 18*a* communicates with the distributor-advance vacuum port of the controlling liquid-fuel carburetor 35 by line means 18*b*, as does vacuum switch 32. Line means 18*c* connects vacuum tank 18*a* to three-way solenoid valve 18; line means 18*d* may communicate with distributor-advance mechanism at 18*e*. When distributor-advance vacuum is at zero vacuum switch 32 is closed, as noted in a preceding paragraph. Three-way solenoid valve 18 is open and vacuum tank is at atmospheric pressure.

As distributor-advance vacuum increases distributor-advance vacuum switch 32 opens and cuts flow of electrical current to three-way solenoid valve 18, closing said solenoid and permitting vacuum to be established in vacuum tank 18*a* and by line means 18*c* and 18*d* through three-way solenoid valve 18 to distributor-advance mechanism 18*e*.

Vacuum rise may be instantaneous in circuit 18 through 18*e* and effect upon distributor-advance mechanism likewise. Acceleration exceptional. Reversal of process may be gradual, although no valves are found in vacuum tank 18*a*, and deceleration may be clean and free of backfire.

I claim:

1. In an Automotive Engine Economizer for air-cooled and/or liquid-cooled internal combustion engines having a separate intake manifold for each bank of cylinders, and by which device the liquid primary fuel and the gaseous secondary fuel are combined with air and employed simultaneously to form the explosive charge, there being a liquid fuel carburetor to supply said charge by means of said intake manifolds to each bank of said cylinders, with said liquid fuel carburetors having been modified to require a percentage of gaseous secondary fuel to complete said explosive charge; an auxilliary liquid propane storage tank with vapor outlet means, located at some convenient place in the vehicle trunk space, communicating with a secondary gaseous fuel storage tank with pressure gauge and safety shut-off means, located in the engine compartment; a hand- and cable-controlled safety shut-off means to facilitate the employ of said gaseous secondary fuel by said air-cooled or liquid-cooled internal combustion engine or to shut down said economizer device or system when required; the combination of cut-off and pressure-regulator means for the gaseous secondary fuel communicating by line means with the modified air filters of said liquid fuel carburetors, said cut-off and pressure-regulator means being dependent upon and responsive to the engine temperature and intake manifold vacuum, there being no mechanical means for control of said gaseous secondary fuel by throttle members; a manifold-vacuum-operated master switch means to energize electrically said economizer device or system, and hot-air-damper-controlled micro-switch ground means or a liquid-coolant sensor switch ground means to establish or interrupt the electrical circuit of said device or system; an exhaust manifold back-pressure-regulated pressure regulator valve in the gaseous secondary fuel supply means, and line means to communicate said exhaust manifold back-pressure to the control chamber of said gaseous secondary fuel pressure regulator valve; a micropressure regulator valve and solenoid valve means communicating with said modified air filters of said liquid primary fuel carburetors, means to supplement restricted liquid primary fuel when said air-cooled or liquid-cooled engine is idling; a distributor-advance-vacuum-operated micro-switch means to energize said solenoid valve; a combination vacuum tank and three-way solenoid valve means to control distributor advance mechanism to stabilize vacuum loses which may appear in the course of the operation of said device or system; a crankcase emission filter means to supply heat necessary to the proper conditioning of said gaseous secondary fuel, and line means to supply heated air from cooling-air dampers of air-cooled engine so equipped, or hose line and valve means to supply heated liquid medium from a liquid-cooled engine to said heat exchanger as needed; said economizer device or system being completely automatic once gaseous secondary fuel hand valve control is open and engine is started.

2. The combination or system as described in claim 1, in which a hot-air damper-controlled microswitch ground means or a liquid coolant sensor switch ground means is normally open on a cold engine to permit said air-cooled or liquid-cooled internal combustion engine to operate with full flow of said gaseous secondary fuel in the manner of an automatic choke.

3. The combination or system as indicated in claim 1, in which a micro pressure regulator valve means with solenoid valve means communicating with the modified air filters of said liquid fuel carburetors is means to supplement restricted liquid primary fuel when said air-cooled or liquid-cooled internal combustion engine is idling.

4. The combination or system as described in claim 1, in which a manifold vacuum-operated master switch is means to de-energize said system or device and to cause said system or device to perform as an auxilliary power circuit whenever said auxilliary power circuit is required.

5. The combination or system as indicated in claim 1, in which the exhaust manifold back-pressure is means to control the diaphragm in the control chamber of a modified gaseous secondary fuel pressure regulator means, to determine the amount of said gaseous secondary fuel to be used at any given moment.

* * * * *

UNITED STATES PATENT OFFICE

CERTIFICATE OF CORRECTION

Patent No. 4,068,639 Dated January 17, 1978

Inventor(s) Earl Charles Cook, aka Rafael Carlos Cook

It is certified that error appears in the above-identified patent and that said Letters Patent are hereby corrected as shown below:

On the Title Page, Item [76], should read:

-- Earl Charles Cook, aka Rafael Carlos Cook --.

Signed and Sealed this

Sixteenth Day of May 1978

[SEAL]

Attest:

RUTH C. MASON
Attesting Officer

LUTRELLE F. PARKER
Acting Commissioner of Patents and Trademarks